United States Patent [19]

Burrell

[11] Patent Number: 4,540,222

[45] Date of Patent: Sep. 10, 1985

[54] CABINET STRUCTURE FOR STORING, DISPLAYING AND INDEXING

[76] Inventor: Alfred A. Burrell, 10223-133th St., Edmonton, Alberta, Canada

[21] Appl. No.: 470,322

[22] Filed: Feb. 28, 1983

[51] Int. Cl.[3] ..... A47F 5/10

[52] U.S. Cl. ..... 312/257 R; 211/175; 211/186; 211/187; 211/190; 312/257 SM

[58] Field of Search ..... 211/105.1, 123, 134, 211/190, 208, 186, 187, 184, 43, 175; 108/108–111, 60, 61, 65; 248/223.1, 222.4, 150, 165, 295.1; 312/111, 3, 201, 257, 5, 250, 257 SM

[56] References Cited

U.S. PATENT DOCUMENTS

| | | | |
|---|---|---|---|
| 985,222 | 2/1911 | Stuck | 108/110 |
| 1,165,703 | 12/1915 | O'Connor | 108/61 |
| 1,578,819 | 3/1926 | Freeland | 312/118 |
| 1,733,487 | 10/1929 | Hackley | 211/184 |
| 2,149,603 | 3/1939 | Hamby | 108/110 |
| 2,899,256 | 8/1959 | Kelly | 312/296 |
| 3,687,091 | 8/1972 | Boylan | 108/111 |
| 3,753,400 | 8/1973 | Miller | 312/250 X |
| 4,084,125 | 4/1978 | King | 312/201 |
| 4,120,250 | 10/1978 | Viessmann | 108/108 X |
| 4,178,844 | 12/1979 | Ward et al. | 211/175 |
| 4,193,650 | 3/1980 | Gray et al. | 108/61 |
| 4,395,955 | 8/1983 | Pfeifer | 211/184 |
| 4,400,043 | 8/1983 | Rossow | 312/3 X |

FOREIGN PATENT DOCUMENTS

| | | | |
|---|---|---|---|
| 811554 | 8/1967 | Canada | 108/111 |
| 823241 | 12/1951 | Fed. Rep. of Germany | 248/295.1 |

*Primary Examiner*—William E. Lyddane
*Assistant Examiner*—Joseph Falk

[57] ABSTRACT

A cabinet structure for space-efficient storage and/or display of a wide variety of small and medium sized items utilizing certain basic parts and offering with optional accessories a versatile storage system that can be assembled to meet the individual requirements of many different users and purposes. The cabinet structure comprises a base, a pair of spaced vertical sides, a back and a top. It can be used alone or means may be provided on the sides to secure it in combination with other related cabinet structures. The structure may carry one or more shelves at selected vertical spacings, the ends of the shelves being removably supported on the cabinet sides and optionally adjustable in width, i.e., from back to front of the cabinet, and the cabinet side supporting means being able to support the shelf ends in the shelf width selected. Provision is made for supporting vertical dividers extending in front to back direction between adjacent shelves at selected spacings. The dividers are held at top and bottom, being compression biased toward the bottom and readily removable against such bias. The compartmented shelves are easily converted into bins by a bin front member that is removably mounted on the front edge of certain dividers by an adjustable pair of divider carried jaws. The cabinet structure is readily convertible to a wide number of configurations alone or in combination with other such structures.

25 Claims, 19 Drawing Figures

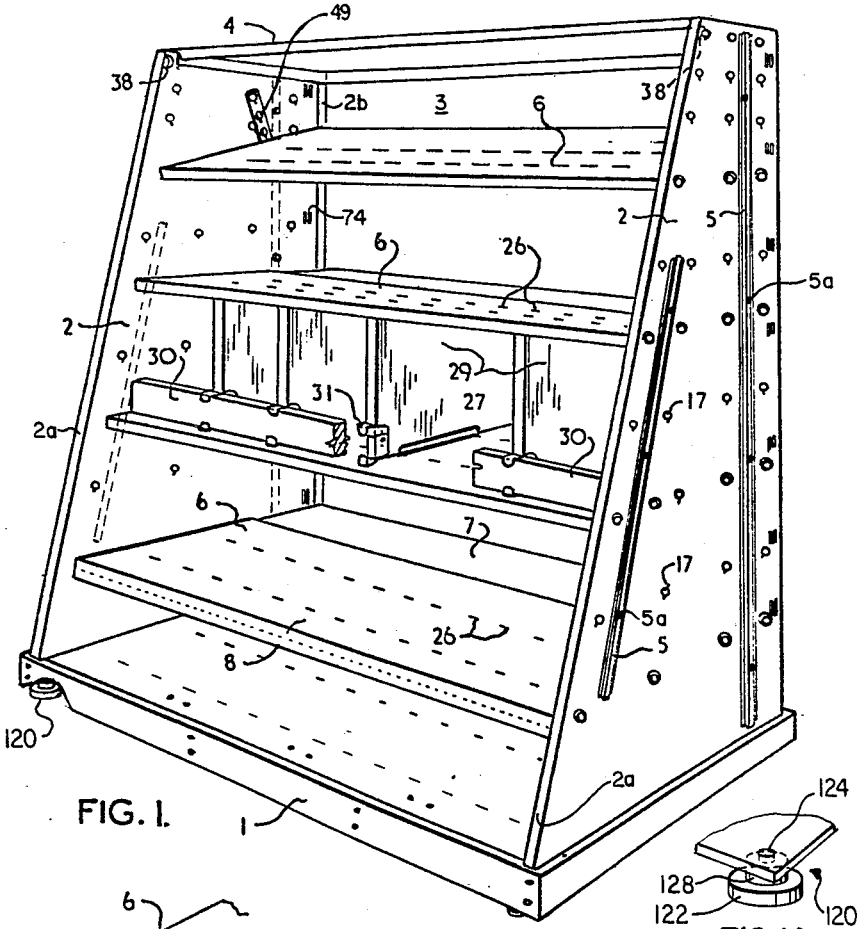
FIG. 1.
FIG. 1A
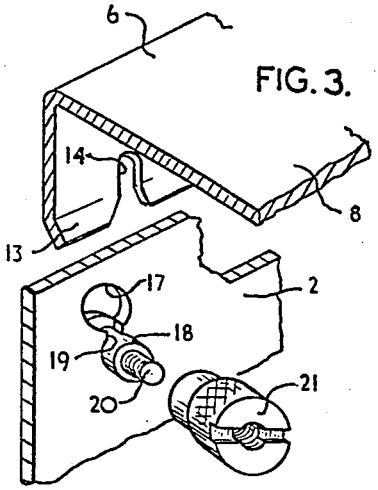
FIG. 3.
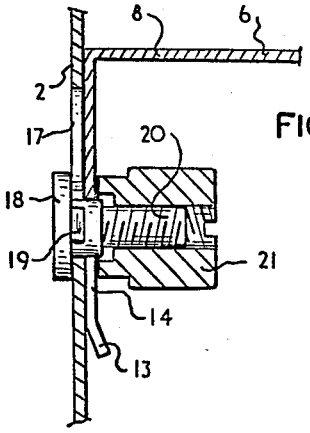
FIG. 2.

FIG. 12
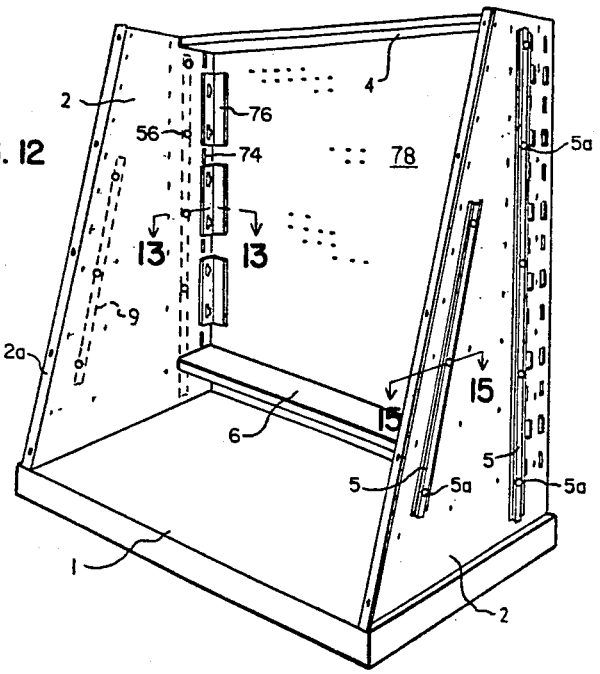
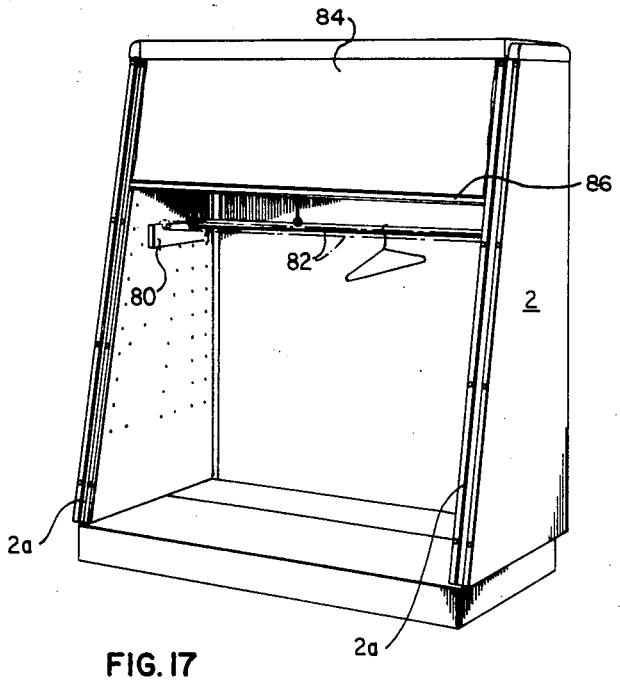
FIG. 17

CABINET STRUCTURE FOR STORING, DISPLAYING AND INDEXING

BACKGROUND OF THE INVENTION

This invention relates to improvements in cabinet structures and especially ones suitable for storage and/or display of a wide variety of small and medium sized products.

There is often a need, particularly in industrial and retail fields, to stock a large inventory of items and parts of graduated sizes and shapes in drawers on shelves, such that a great deal of shelf or drawer space is required. Much time and effort may be consumed in locating an ordered part or consumer product from such a setup. Attempts have been made to efficiently and economically store industrial parts and consumer products. See, for example, my earlier U.S. Pat. No. 3,856,370 issued Dec. 24, 1974, which describes and illustrates a stand of upright frusto-conical form having a plurality of compartments accessible from all parts of its perimeter. See also, for example, Luvara et al Canadian Pat. No. 967,515 issued May 13, 1975 which describes and illustrates a modular compartmented storage unit constructed with interchangeable elements and which may be sub-divided as required into smaller compartments.

To meet the need for a versatile, space-efficient storage system, a cabinet to receive tiered shelves is desirable which will allow simple changes in the vertical spacing of shelves, maximum utilization of space, and a variety of optional arrangements in the separation of shelves into compartments and the provision of drawers and bins and the like. Where the front of the cabinet is inclined so that it tapers to the top, shelves of different width become necessary so that shelves that are adjustable as to width reduce the number of different parts required. Provision of a simple means to install and relocate shelves is another factor to be considered in supplying that includes a standard series of cabinets, useable alone or in combination with other similar or compatible units.

SUMMARY OF THE INVENTION

According to the present invention there is provided a cabinet structure for space efficient storage and/or display of a wide variety of items and products utilizing certain basic parts and offering with optional accessories a versatile storage system that can be assembled to meet the individual requirements of many different users and purposes. The cabinet structure comprises a rectangular base horizontally positioned on a support surface, spaced vertical sides and a back and top and one or more support structures extending between the spaced sides of the cabinet. The sides of the cabinet structure are made of rigid, sheet material having therein a series of vertically spaced horizontal rows of regularly positioned holes to receive bolt fastening means which co-operate with the ends of the support structure or structures to releasably support them in a variety of horizontal positions. The cabinet structure may be provided with adjustable shelves which may be sub-divided by means of vertical dividers into smaller shelf areas or bins, or they may support slideable drawers. The shelves may also be inclined from back to front for better display or selection of items carried on them. The outsides of the vertical sides may be reinforced by external spaced upstanding inwardly facing channel members secured near the front and back edges respectively, these members assisting in securing additional cabinet structures to this initial one, or in securing a side finishing panel to each cabinet side. The structure also permits the securing of pegboard in vertical orientation towards the back of the structure for display of products.

It is an object of the present invention to provide a cabinet structure which will permit space-efficient storage and/or display of a wide variety of items, particularly of small and medium size, utilizing certain basic parts and offering with optional accessories a versatile storage system that can be assembled to meet the individual requirements of many different users and purposes.

It is a further object of the present invention to provide such a cabinet structure which permits easy sectional indexing for ease in identification of the location of parts stored therein.

BRIEF DESCRIPTION OF THE DRAWINGS

These and other objects of the invention will become apparent upon reading the following detailed description and upon referring to the drawings of example embodiments of the invention in which:

FIG. 1 is a perspective view of a cabinet structure according to the present invention with certain parts broken away to show structural detail;

FIG. 1*a* is a detail of an adjustable support foot for the cabinet structure;

FIG. 2 is an enlarged vertical section of a shelf attaching means;

FIG. 3 is an exploded perspective view of the shelf attaching means of FIG. 2;

FIG. 12 as shown on the fifth page of drawings, is a partial, perspective view of the cabinet structure of FIG. 1 arranged to receive a shelf and a backing of pegboard;

FIG. 17 is a perspective elevation of a cabinet structure according to the present invention modified as a hanger unit and provided with a blind;

Figure 4:
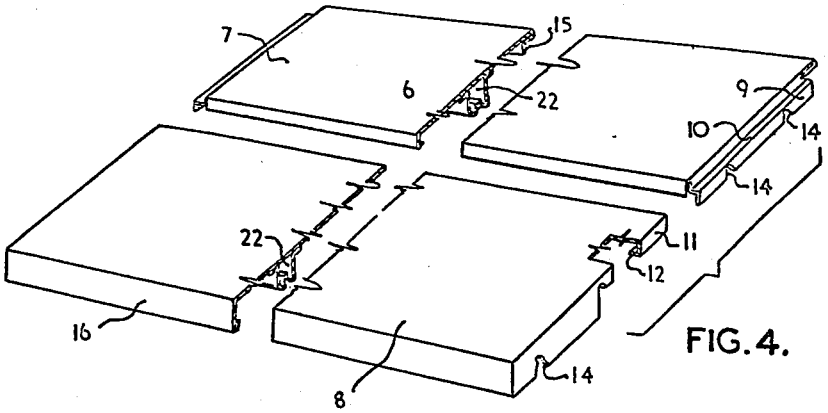
FIG. 4 is a perspective view of a two-part expandable shelf according to the present invention.

While the invention will be described in connection with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings similar features have been given similar reference numerals.

Referring now to the drawings, a modular cabinet structure system is shown which has been designed to meet the need for a standardized unit having certain basic parts with optional accessories, which is readily adaptable to provide an optimal storage system with extremely efficient utilization of volume space within the structure. The structure may be used alone or in combination with other like or compatible units and affords the individual user an infinite choice of shelf spacing and compartments, bins etc.

Figure 8:
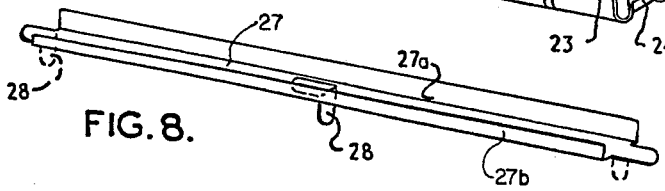
FIG. 8 is a perspective view of a shelf-carried channel device for locating the lower edge of a vertical partition or shelf divider.
Figure 18:
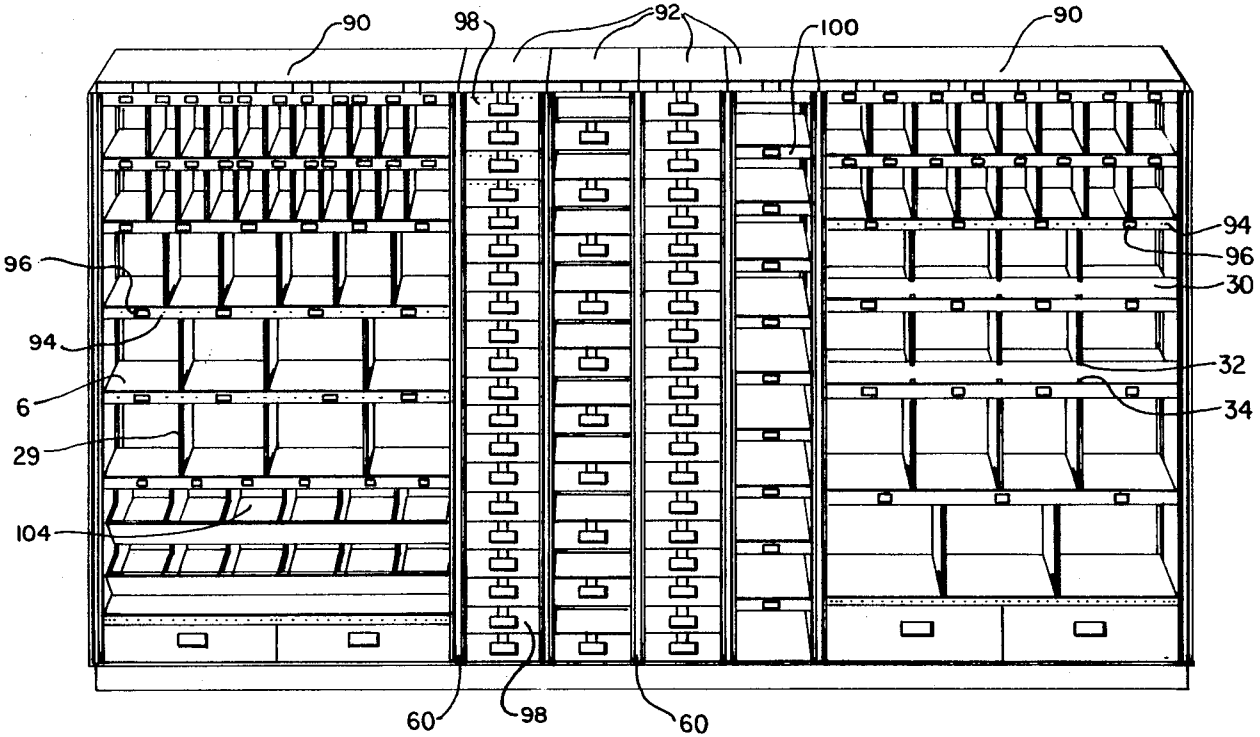
FIG. 18 is a perspective view of an assembly of cabinet structures according to the present invention.

In FIG. 1, an example embodiment of a modular cabinet structure according to the present invention is shown having a base 1 of rectangular outline, a pair of spaced vertical sides 2 inclined at the front edge tapering to the top, a back 3 and a top 4. Alternatively, the sides may have vertically oriented front edges, as illustrated in FIG. 18. The base 1 may, for example, consist of flanged channel members of appropriate lengths to which are bolted plywood panels (eg. ½ inch thick), the plywood panels supporting a flat metal base member appropriately perforated to receive tabs 28 of divider channels 27 (FIG. 8) as required. The load bearing sides 2 are rigidified and strengthened by spaced inwardly facing channels 5 secured on their outer surfaces near front and rear edges respectively. Vertically spaced holes 5*a* in the channels register with corresponding holes on the sides 2. The sides 2 are preferably of sheet metal, with out-turned flanges 2*a* at their front edges and in-turned flanges 2*b* at their back edges. The inclined front of the cabinet, by tapering its sides toward the top, increases the visibility of items displayed in the cabinet and facilitates their storage and removal. This design calls however for the provision of shelves of different widths and this can inhibit the easy or frequent rearranging of the vertical spacing of the shelves. To overcome this handicap I provide a shelf that is readily adjustable in width and fabricate the cabinet sides 2 so that a given shelf may be selectably supported at different vertical levels in the appropriate and different widths required.

Figure 5:
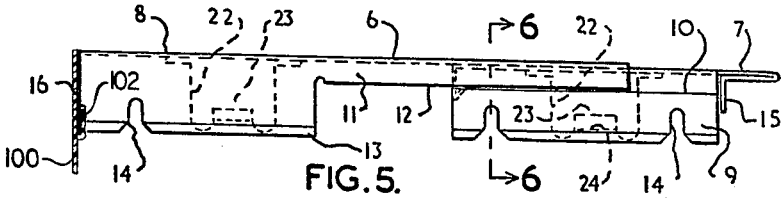
FIG. 5 is an end elevation of the expandable shelf.
Figure 6:
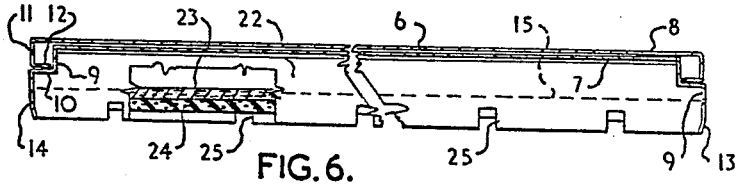
FIG. 6 is a section therethrough as taken along line 6—6 of FIG. 5.
Figure 7:
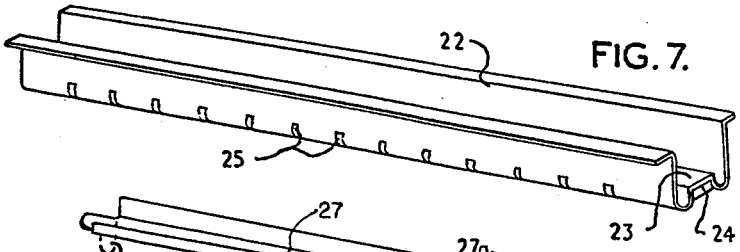
FIG. 7 is an enlarged perspective view of a shelf reinforcing channel according to the present invention.

In FIG. 1, four tiered shelves 6, and the top 4 that may also be constructed as a shelf, will be seen to be of uniform length between the cabinet sides 2 and of progressively reducing width from bottom to top. Each shelf 6 other than the top one comprises two complementary full length sections 7 and 8 that are adjustable being in telescopic sliding relation so that they are expandable in width, that is in their front to back dimension. This two part expandable width shelf is clearly shown in FIGS. 4, 5 and 6. The rear section 7 is provided with depending ends 9 the lower parts of which are outwardly offset by a step 10. In the front section 8, the inner portion of its depending ends 11 are formed with inturned flanges 12 at the same depth as the step 10 of the rear section to normally rest thereon and the front section ends and the lower part of the rear section ends below said step are coplanar. The front section ends, in advance of the flanged inner portion 11 and the rear section ends 9 below the step 10 depend to a common level being terminally provided with an inwardly disposed shallow incline 13. In such depending ends, and rising to a level above said incline, said section ends have vertical notches 14 with flared mouths. The front section 8 with its flanged ends 12 riding on the rear section steps 10 overlies the rear section 7 and is extendable up to the width allowed by the length of its flanged inner ends 11. It will be noted that the rear section 7 has two spaced notches 14 in each end whereas the front section 8 has only one such notch at each end located near the front edge since the rear of the section overlies and rests on the rear section and is also restrained in lengthwise shift by the interlocking flanged and stepped ends engagement. In the wider shelves near the bottom of the cabinet the front section may have two notches on each end. The rear section has a doubled under rear edge with a shallow depending flange 15 and the front section is finished across the front edge by a flange 16 depending to the depth of the notched ends of the section.

To support the adjustable width shelves 6 in selected expanded width on the cabinet sides 2 and to facilitate their easy installation and removal I provide a grid of keyhole perforations or holes 17 in the sides 2 in vertically spaced horizontal rows and for them provide a novel shelf-suspending type of bolt 18, see FIGS. 2 and 3, having a head that can pass through the main circle of the perforation and an integral collar part flattened on opposite sides 19 to have sliding fit in the narrow depending slot on the keyhole perforation 17, beyond which flattened sides the collar extends for a distance approximately the thickness of the metal of the shelf section before continuing in a threaded stem 20 of reduced diameter that carries a knurled nut 21. When the vertical level of the shelf to be mounted is determined, the bolts 18 are installed in the appropriate horizontal row of keyhole perforations 17 and pressed down with the flattened sides 19 of the collar in the narrow depending slot of the keyhole where the bolts with their nuts 21 loosened are self-suspending. The rear shelf section 7 is then applied with the flared notches 14 in the inclined ends 13 easily locating on the inner reach of the bolt collars whereupon the nuts 21 are tightened to securely hold the section in place, the front shelf section 8 is then applied with its rear portion in overlapping relation and the slot or slots 14 in its ends located on its bolts 18 and tightly secured in place.

While the shelf sections may be supported directly by these bolts and nuts, they may alternatively be supported on, for example, square tubular brackets which are provided with appropriately spaced holes to conform with keyhole perforations 17, the brackets being bolted in an appropriate fashion, horizontally, to sides 2.

In fashioning the rows of perforations 17 in the sides 2 it will be seen in FIG. 1 that always the two bolt holes 17 for rear shelf section 7 support have a constant spacing from the back whereas the one or two bolt holes for the front section follow the incline or taper of the front edge of the sides 2. Furthermore it will be seen that a given width of front section 8 may be used in a number of extended positions and also that at certain levels a choice is given of using either the last width or next narrower width of front section. It is also possible to alert the user to the preferred size or sizes of outer shelf sections to be used by the angle of decline of the keyhole's narrow slot, e.g. if three widths of outer shelf sections are to be used the employment of the wide, middle and narrow sections may be suggested by declining the keyhole slots at 7, 6 and 5 o'clock respectively.

It will be noted in FIG. 1 that upper shelf 6 is angled to slope downwardly in the forward direction. While the front of that shelf is supported on bolts as previously described the edges of the elevated rear portion are supported on "L"-shaped brackets 49 which brackets are provided with a series of holes and secured by bolts 18 in an appropriate one of those holes and in appropriate holes 17 in sides 6 to give the desired angle to shelf 6.

Figure 9:
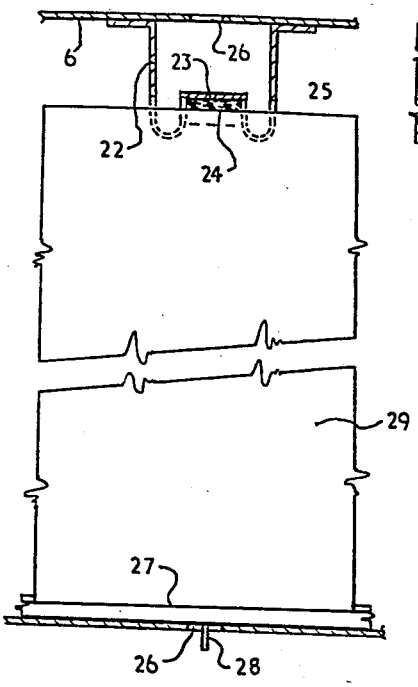
FIG. 9 is a sectional elevation of a vertical shelf divider held between the shelf reinforcing channel and partition locating channel at top and bottom respectively, as viewed from the side of the divider.
Figure 10:
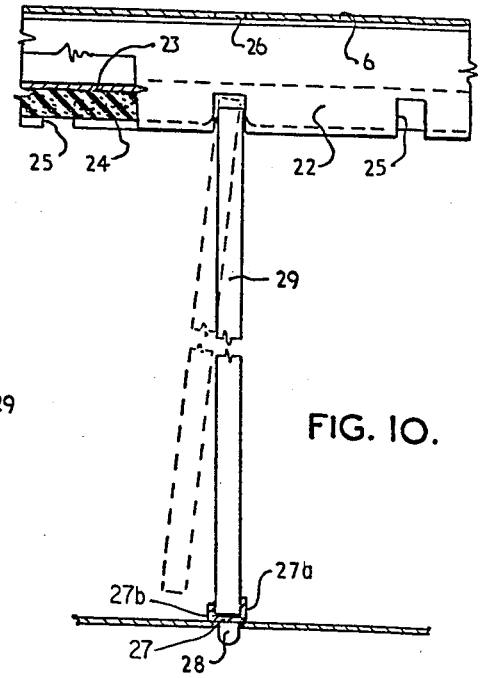
FIG. 10 is a section of the same assembly as seen from an end of the divider.

To meet the varying demands on these shelves, each section is preferably strengthened with a longitudinally extending reinforcement members 22 of U-shaped cross-section with outwardly flanged side walls welded or otherwise secured on the underside of the shelf section, a central downwardly facing trough 23 in the base of said U, a compressible filler 24 therein such as a strip of rubber or the like and a series of slots 25 disposed transversely of the U-shaped reinforcement that rise above the bottom of the filler 24. In addition to reinforcing the shelves 6 to a load bearing capacity in excess of 200 kgs the transversely slotted reinforcement members provide one of many possible storage facilities available to the cabinet user. By appropriately scoring longitudinally spaced rows of slits 26 in the shelves 6, and if desired in the surfacing of base 1, a shallow channel 27 having one side or flange, 27*a* of greater height than the other, 27*b* (see FIG. 8), with at least two downwardly extending tabs 28 for fitting in these slits 26, may be mounted where desired at spaced intervals along the length of each shelf. A vertical partition or divider 29 of cardboard or plywood or the like can then be installed at desired spacings along the shelf to extend from front to back of the cabinet, see FIGS. 9 and 10, by inserting the top edge of the divider 29 in the selected slot 25 of the reinforcement member 22 until it contacts the filler 24. The divider is then forced upwardly compressing the filler until its lower edge can clear the lower wall 27*b* of the underlying channel 27 when it is swung into registry and downwardly biased under compression of the filler to sit in the shallow channel. The top edge of the divider is thereby securely held in the transverse notch 25 of the shelf reinforcement member 22. The divider is easily removed or relocated by reversing the operation and raising the divider against the downwardly compression bias of the resilient filler 24. Not only can the shelves be separated into compartments by the vertical dividers 29 but by providing horizontally spaced holes at similar heights in cooperating, spaced, adjacent vertical dividers, this same channel 27 can be used to support horizontally positioned shelves between the vertical dividers. Tabs 28 of channels 27 are inserted in appropriate mating holes, with the flange 27*a* in the lower position to assist in supporting the inserted shelves. Horizontal partitions are introduced into such channels (positioned at similar heights on the dividers) to break the vertically separated compartments into a plurality of horizontal compartments of smaller size.

The versatility of the cabinet which allows the removable mounting of expandable shelves at selected levels, the adjustment of the width of such shelves, the easy installation and removal or relocation of vertical dividers between the shelves and application of horizontal partitions between adjacent vertical dividers if desired is further enhanced by the ease of using some or all of the open fronted and divided shelves as drawer receptacles or converting them into bins by the application of an easily and quickly removable front wall which will now be described.

Figure 11:
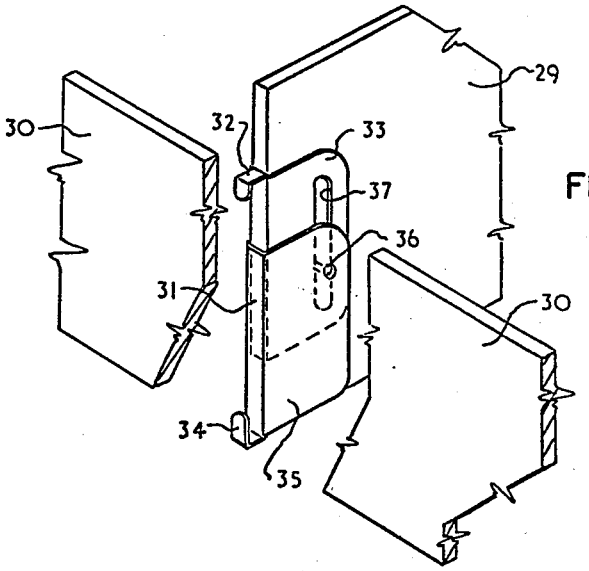
FIG. 11 is a perspective view of a vertical bin-forming panel and the device for mounting the same across the front of the shelf dividers.

A vertical bin defining a front 30 being a planar member of plastic, plywood or the like may be removably carried by the front edges of selected dividers 29 by a coacting pair of jaws 31 on such dividers that releasably engage the bottom and top edges of the bin front 30, see FIGS. 1 and 11. The upper jaw 32 is formed as an outwardly projecting finger terminating in a depending tab carried on the upper edge of a deep channel socket 33 that fits over the front of a divider. The lower jaw 34 is formed as an upwardly extending tab on a similar finger projecting from the lower edge of a channel socket 35. The lower jaw socket 35 embraces the upper jaw socket 33 and is secured to the divider 29 with its lower jaw 34 level with the bottom of the divider by a transverse fastener 36 passing through the sides of its channel socket as well as those of the upper channel socket 33, the sides of such upper channel socket being slotted as at 37 to allow the vertical sliding of the upper jaw 32, when the fastener 36 is loosened, for clamping or releasing of bin front 30—or to accommodate a bin front of different height. When in position, the bin fronts 30, shelves 6 and dividers 29 define bins on the shelves for holding articles.

If it is desired to close up the cabinet structure, for example at night, as will be described and illustrated in more detail subsequently, a simple pull down/retractable cover may be used for which purpose socket parts 38 (FIG. 1) are universally provided in the front upper corners of sides 2 of appropriate cabinet structure.

In FIG. 12 an alternative embodiment of the cabinet structure according to the present invention is illustrated in which pegboard 88 is supported. Cabinet sides 2 again are inclined on the front edge, i.e. tapering towards the top, for assembly with similar or compatible structures. The cabinet sides 2 have inturned flanges 2*b* at the back edge with vertically spaced perforations 40 (FIG. 13) while the cabinet back 42, which may be of plywood has registering perforations 44 near opposite edges, through which registering pairs of perforations fastening means such as bolts and nuts 46 extend to secure the back in place. When two cabinets are to be connected as a unit in abutting back-to-back relation, the inturned back edge flanges 2*b* of both cabinets are connected by the bolts 46 with the plywood back 42 sandwiched therebetween (FIG. 5) utilizing but one back 42 and a single set of fastening means.

The sides 2 are reinforced for rigidity and to withstand reasonable loads by upstanding inwardly facing U-shaped channel members 5 having a base 50 (FIGS. 13 to 16) in which are vertically spaced perforations 5*a*, and parallel sides 52 with outwardly extending flanges 54 welded or otherwise secured on the outer surface of the sides 2 near the front and rear edges as illustrated. Holes or perforations 56 in the sides 2 register with the channel perforations 5*a*.

In FIG. 12, top 4 is of narrow width and positioned to the rear to provide illumination for and visibility of items which may be stored near the top of pegboard 88. Appropriate finishing elements (not shown) may be fitted on the upper ends of sides 2 to cover these partially exposed (front) upper ends.

Figure 15:
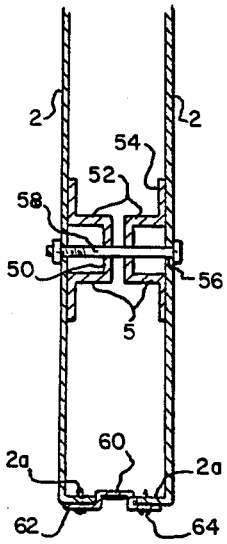
FIG. 15 is an enlarged horizontal section of a pair of cabinet structures joined together at one side and provided with a molding strip between them, as if taken on line 5—5 of FIG. 12.
Figure 16:
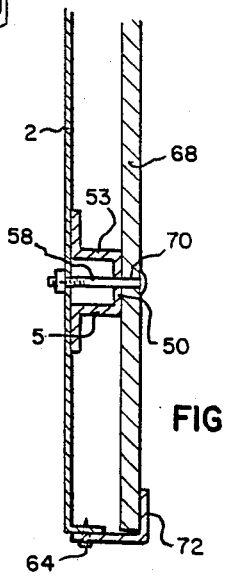
FIG. 16 is a similar section showing a manner of mounting a finished panel on an exposed side of a cabinet structure.

When two cabinets are to be connected as a unit in abutting side by side relation as in FIG. 15, fastening means 58 (e.g. nuts and bolts) are accommodated in the registering perforations 5*a* and 56 of two aligned cabinet structures. Also to be noted here is that out-turned flange 2*a* at the front edge of sides 2 has less width than the depth of sides 52 of reinforcing channel 5. A molding strip 60 of recessed channel shape with outwardly extending side flanges 62 is applied to the gap between the confronting flanges 2*a* by self-tapping screws 64 through registering vertically spaced perforations in the side flanges 2*a* and molding strip flanges 62 respectively, the recessed channel of the strips serving as a precise spacer for the cabinets of the unit.

Where a cabinet is to stand alone or at the end of a row of cabinets connected in a unit, with the outer surface of a side 2 exposed, a finishing panel 68 (FIG. 16) of the same perimetral shape as cabinet side 2 is employed. Panel 68 is provided with perforations 70 that register with perforations 5*a* in the reinforcing channels and perforations 56 in cabinet sides 2 through which fastening means 58 extend. Either a molding strip 60 or an angle 72 fastened to the front edge flange 2*a* by tap screws 64 may be used to finish the cabinet edge.

Figure 13:
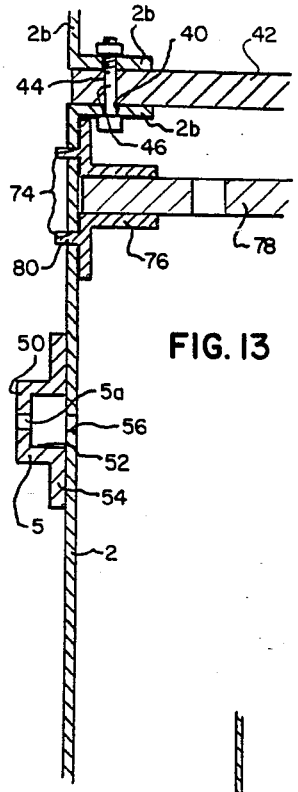
FIG. 13 is an enlarged horizontal section as if taken on line 13—13 of FIG. 12, showing a manner of connecting cabinet structures in back-to-back relation.
Figure 14:
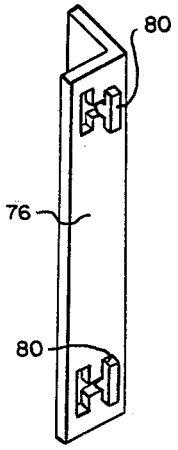
FIG. 14 is a perspective view of a removable bracket for holding a pegboard in place in the cabinet structure.

Though a wide variety of items, accommodating devices such as shelves, drawers, bins and the like, may be selected to provide for efficient storage of a multitude of items, a removable pegboard has been illustrated in the embodiment of FIG. 12 for the display of articles. To this end the modular cabinet structure sides 2 each have a spaced pair of rows of vertically elongated slots 74 cut therein that extend vertically between the rear channels 5 and the back edge flanges 2*b* as shown in FIGS. 12 and 13. These slots 74 removably hold angled brackets 76 (FIG. 14) hooked therein and co-operating on opposite sides of pegboard 78 to support it. The brackets 76 are formed as angles with T-shaped lugs 80 struck exteriorly from one of the sides of the angle while the other side remains plain, the vertical spacing of the lugs being compatible with that of the slots 74 (see FIG. 14). A removable shelf 6 is mounted between the cabinet sides 2 at the desired height and thereabove a series of vertically spaced brackets 76 are hooked in the rearmost row of slots 74 of each side 2 with the plain sides of the bracket facing outwards. Next the pegboard 78, resting on the shelf 6 and being of a height to reach to the top 4 and of a width to extend between the sides 2, is pressed back against the brackets 76. A second series of brackets 76 in reversely facing arrangement, i.e. with the plain side of the angle facing rearwards, is then hooked in the slots of the forward vertical row on each side, thereby snugly and securely supporting the peg-board 78 against rearward and forward displacement.

In FIG. 17 there is shown a modification of cabinet structure according to the present invention in which to cabinet sides 2 are secured brackets 80. Brackets 80 are provided with a plurality of grooves 81 on which may be supported one or more hanger rods or bars 82. A single bar 82 provides for garment hanger support, while dual parallel bars 82 provide for supporting T-shaped products such as garden rakes, shovels, brooms and the like. A pull down/retractable cover 84 having a metalic draw bar 86 the ends of which travel in facing channels associated with flange 2*a* on the front edges of sides 2 may be provided for periodically securing the contents of the cabinet structure from public view or contact.

An assembly of modular cabinet structure units in both side-by-side and back-to-back relationship may be achieved according to the present invention. The structure lends itself to kiosk setups for example in shopping centre malls, where a retailer may have a series of display cabinets surrounding a central work area, so the merchandise being displayed in cabinets thereabout. Cabinet structures for warehouse storage may be of greater height, e.g. 70 inches, than those for retail applications, e.g. 49 inches in height.

A composite structure incorporating several cabinet structure units according to the present invention is illustrated in FIG. 18. The sides 2 of the cabinet structures are of rectangular shape. Two wide cabinet structures 90 have been secured as described hereinbefore to four narrow cabinet structures 92. Cabinet structures 90 and 92 and molding strips 60 are secured together as has been hereinbefore described. Shelves 6 have been appropriately positioned in all of the cabinet structures. These may be of a fixed width type, or expandable in width (FIG. 4). A number of the shelves have been partitioned with vertical dividers 29. Vertically depending flanges 94 having holes to receive bendable ears from the sides of name plates 96, are provided on the front of certain of the shelves 6. Drawers 98 are removably resting on a number of the shelves. Again holes to receive name plates 96 are provided in the front faces of these drawers 98 as illustrated. Vertical bin walls 30 are illustrated on certain of the shelves 6 secured by means of jaws 32 and 34 held on dividers 29. On vertically depending front flanges 16 of certain of the shelves, plastic label strips 100 are frictionally held in position by means of groove 102 (see FIG. 5 for detail) on the back of the strips. The strips again are provided with perforations for receiving bendable side ears of labels 96. Identification or indexing of the various areas and sections of the structure can thus be readily accomplished. As well, these strips protect the hands of users of the cabinet structures from scrapes on the lower edges of flanges 16.

Bins 104 may be constructed and supported as required.

For the cabinet structure to operate most effectively, it should be as horizontally level as possible. To achieve this it may be supported on similar, vertically adjustable levelling feet 120 (FIG. 1A) of a standard threaded construction, each having a foot pad 122 and threaded stem 124 received in a threaded socket 126 in the underside of base 1. Each foot 120 is additionally provided with a cylindrical breakable collar 128 of similar length, circumscribing the stem 124. The collar is made, for example of brittle plastic. When each foot 120 is screwed into its socket 126 until the upper end of collar 128 contacts the underside of base 1, a central similar starting point for the adjustment of each foot is achieved. In other words, the sleeve serves as an initial stop to ensure that all feet are of equal height in advance of adjusting for uneven floors. If the foot must be adjusted downwardly, for horizontal support of the cabinet structure at that position, it is unscrewed from the socket a desired amount; if it is to be adjusted *upwardly*, it is screwed into the socket shattering the collar, a desired amount. This feature saves considerable time in adjusting the cabinet structure since the feet need to be adjusted only once.

Thus there has been provided in accordance with the invention a cabinet structure that fully satisfies the objects, aims and advantages set forth above. The versatility of the cabinet structure according to the present invention, as well as the efficient manner in which it utilizes space can be readily appreciated from the foregoing. For example, high and low cabinet structures may be combined as required. Cabinet structures with tapered sides, as illustrated in FIG. 1, may be combined, back-to-back with rectangular sided structures such as illustrated in FIG. 18. While the invention has been described in conjunction with specific example embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A cabinet comprising a base, spaced vertical sides, a back and a top, a plurality of removable shelves extending between the spaced sides of the cabinet, said shelves being expandable in width with each comprising two complementary full-length sections indivdually supported at their ends by said cabinet sides, a longitudinally extending reinforcing member on the underside of each shelf section having a downwardly facing trough with a compressible filler therein and spaced transverse slots that rise above the bottom of said compressible filler, said shelf sections having longitudinally spaced rows of cuts in vertical registry with said reinforcing member slots, shallow channels with downwardly extending tabs seated in selected rows of cuts on at least one shelf, vertical partitions removably supported in confronting reinforcing channel slots and shallow channels being downwardly biased by said compressible filler, co-acting upper and lower jaws mounted on the edges of said vertical partitions, each lower jaw being in fixed position and each upper jaw being vertically adjustable and a vertically oriented planar front member removably secured across the front of a shelf by partition carried jaws to define with a respective shelf and dividers at least one bin.

2. A cabinet structure for storage or display comprising a rectangular base to be horizontally positioned on a support surface, spaced vertical sides and a back and top, and a plurality of shelves extending between said spaced sides, said vertical sides being inclined on the front, rearwardly tapering toward the top, and being made of rigid sheet material and having therein a series of vertically spaced horizontal rows of regularly positioned holes, bolt fastening means passing through said holes to co-operate with ends of said shelves to releasably support said shelves in a variety of horizontal positions, at least one of said shelves having two complementary full-length sections extending between said sides and being in telescopic sliding relation to each other to permit said one shelf to be expandable in width from front to back, both sections of each expandable shelf having depending ends for attachment to the cabinet sides, and wherein the rear section has a lower part of the depending ends thereof each provided with an offset step and a front section has an inner portion of the depending ends thereof of the same depth as the upper part of the rear section ends and provided with an inturned flange that normally rests on the outwardly offset step of said rear section so that the respective front section ends and the lower part of the rear section ends are coplanar.

3. A cabinet structure according to claim 2, both shelf sections having flanged ends for attachment by way of the bolt fastening means to the cabinet sides, the horizontal rows of holes being arranged to receive the bolt fastening means to secure the front section to the cabinet sides at a predetermined vertical height in a selected expanded width.

4. A cabinet structure according to claim 2 further comprising means for separately supporting opposite ends of both front and rear sections of the shelves, each such means comprising a bolt selectively positioned in a keyhole-shaped perforation in a side of the cabinet, the bolt having a collar with opposite sides flattened to fit and be releasably held in a non-rotatable relation in the narrow slot of the keyhole perforation.

5. A cabinet structure according to claim 6 wherein each shelf section has depending ends for attachment to the cabinet sides, and wherein the depending ends of the front and rear shelf sections have spaced vertical notches extending up from their lower edges adapted to straddle the bolts and nuts on the bolts for securely clamping the shelf section ends to the cabinet sides, the notches having flared mouths to facilitate the mounting of the shelf sections on the bolts.

6. A cabinet structure according to claim 2 having removable vertical dividers running from front to back and at selected spacings along the length of the shelves, the dividers when in position being downwardly biased under compression and removable against such compression.

7. A cabinet structure according to claim 6 wherein each shelf has secured to its underside a longitudinally extending reinforcement member of U-shaped cross-section with a central downwardly facing trough, a compressible filler in the trough and divider-accommodating slots disposed transversely of the U-shaped reinforcement member, which slots rise above the bottom of the filler.

8. A cabinet structure according to claim 7 wherein the shelves are provided with longitudinally spaced rows of perforations, the cabinet structure being further provided with a shallow channel member having at least two downwardly extending tabs insertable in the perforations to secure the channel member to the corresponding shelf, and a partition fitted in the transversely disposed slots and compressed against the filler in the shelf reinforcement member and resting in the channel member.

9. A cabinet structure according to claim 8 wherein the channel member has a U-shaped cross-section, one of the arms of the channel member being of less height than the other.

10. A cabinet structure according to claim 2 having removable vertical dividers at selected spacing along the length of the shelves and a vertically oriented planar front member removably carried by the front edges of the dividers on at least one shelf to define at least one bin with said shelf and said dividers.

11. A cabinet structure according to claim 10 wherein the dividers have co-acting upper and lower jaws removably embracing their front edges, the jaws releasably engaging the planar front member, the upper of the jaws being vertically slidably mounted on the divider.

12. A cabinet structure according to claim 2 further provided with a pair of L-shaped brackets, the arm of each bracket being provided with a plurality of holes, the brackets to be secured by the bolt fastening means at corresponding locations at the rear of the cabinet structure sides so that the base section of the bracket will support thereon the rear of a shelf section in position inclined from front to rear.

13. A cabinet structure according to claim 2 wherein the vertical sides are reinforced on their outsides by external spaced upstanding inwardly facing channel members secured near the front and back edges respectively, the base of the channels being provided with spaced perforations and the cabinet sides having perforations in registry therewith for accommodation of fastening means when corresponding cabinet structures or finishing panels of the same perimetral shape as a cabinet side are secured together in side-by-side relationship.

14. A cabinet structure according to claim 13 wherein the sides have an inturned flange at the back edge provided with vertically spaced perforations and the back of the cabinet is provided with registering perforations for the accommodation of fastening means.

15. A cabinet structure according to claim 13 having a side finishing panel of the same perimetral shape as the corresponding cabinet side, the panel being provided with perforations registering with those in the reinforcing external channel members and fastening means extending through the panel, channel and cabinet side.

16. A cabinet structure according to claim 13 further provided with a molding strip for the vertical sides of the cabinet on the front, the molding strip being of recessed channel shape with wide outwardly extending side flanges in cross-section, and wherein the cabinet side front and the molding strip flanges have registering perforations, and securing means for the registering perforations to secure the corresponding flange of the molding strip to the corresponding cabinet side front, wherein when two cabinet structures are secured in side-by-side relationship, the molding strip serves as a closing means for the gap between the side-by-side cabinets and the side walls of the recessed channel of the molding strip lies between the confronting side fronts of the respective cabinet structures acting as a precise spacer therefor.

17. A cabinet structure according to claim 2 wherein the sides of the cabinet structures each have a spaced vertical pair of vertical rows of slots cut therein, two sets of brackets removably mounted in the respective rows of slots and a pegboard disposed between the sides of the cabinet and securely supported by the respective sets of brackets against rearward and forward displacement.

18. A cabinet structure according to claim 2 further provided with an elongated strip having means to releasably secure the strip to the front edge of the shelf and having perforations to receive tabs of a label holder for securing the label holder to the strip.

19. A cabinet structure according to claim 18 wherein the front edge of each shelf ends in a vertical flange section, and wherein the strip is provided with a groove to releasably receive the end of that flange in frictional engagement therewith, the strip being of predetermined length to provide label indexing for a predetermined length of shelf.

20. A cabinet structure according to claim 2 further provided with bins supported on the shelves.

21. A cabinet structure according to claim 2 supported on vertically adjustable feet having a foot pad and upwardly extending threaded stem each received in a threaded socket secured to the underside of the base, the feet being of uniform construction and each being provided with a cylindrical collar of similar length circumscribing the stem, the collar being breakable to enable the foot to be upwardly adjusted after the upward edge of the collar has come into contact with the corresponding edges of the socket.

22. A cabinet structure according to claim 2 which further comprises a pair of similarly shaped wall brackets secured to said sides and an elongated bar from which objects may be hung extending between said sides and supported on a pair of said brackets.

23. A cabinet structure according to claim 2 further comprising blind means rotatable on socket means secured to the cabinet structure, the roller blind extending across the open front of the cabinet structure to close it when the blind is in drawn position.

24. A cabinet structure according to claim 2 further provided with movable drawers supported on at least some of said shelves.

25. A cabinet structure for storage or display comprising a rectangular base to be horizontally positioned on a support surface, spaced vertical sides and a back and top, and a plurality of shelves extending between said spaced sides, said vertical sides being inclined on the front, rearwardly tapering toward the top, and being made of rigid sheet material and having therein a series of vertically spaced horizontal rows of regularly positioned holes, bolt fastening means passing through said holes to co-operate with ends of said shelves to releasably support said shelves in a variety of horizontal positions, at least one of said shelves having two complementary full-length sections extending between said sides and being in telescopic sliding relation to each other to permit said one shelf to be expandable in width from front to back;

removable vertical dividers running from front to back and at selected spacings along the length of the shelves, the dividers when in position being downwardly biased under compression and removable against such compression;

each shelf having a longitudinally extending reinforcement member of U-shaped cross-section with a central downwardly facing trough secured on an underside, a compressible filler in the trough and divider-accommodating slots disposed transversely of the U-shaped reinforcement member and rising above the bottom of the filler.

* * * * *